United States Patent [19]

Kamidaira

[11] Patent Number: 4,937,632

[45] Date of Patent: Jun. 26, 1990

[54] CLEANING DEVICE OF IMAGE-FORMING APPARATUS

[75] Inventor: Kazuya Kamidaira, Nara, Japan

[73] Assignee: Mita Industrial Co., Ltd., Osaka, Japan

[21] Appl. No.: 321,747

[22] Filed: Mar. 10, 1989

[30] Foreign Application Priority Data

Apr. 11, 1988 [JP] Japan ..... 63-88663

[51] Int. Cl.[5] ..... G03G 21/00

[52] U.S. Cl. ..... 355/299; 118/652

[58] Field of Search ..... 355/299, 296; 118/652

[56] References Cited

U.S. PATENT DOCUMENTS

| | | | |
|---|---|---|---|
| 3,859,691 | 1/1975 | Katayama et al. | 355/299 X |
| 4,400,082 | 8/1983 | Kiba | 355/299 |
| 4,417,365 | 11/1983 | Murasaki | 355/299 X |
| 4,564,283 | 1/1986 | Fox et al. | 355/299 X |

*Primary Examiner*—A. T. Grimley
*Assistant Examiner*—Robert Beatty
*Attorney, Agent, or Firm*—Wenderoth, Lind & Ponack

[57] ABSTRACT

A cleaning device of an image-forming apparatus includes a soft elastic member movable in the direction of the axis of the shaft line of an elastic blade, and an interlocking mechanism for moving and separating the soft elastic members toward and away from each other during the rotation of the elastic blade. The soft elastic members may be engaged with the end of the blade when a pointed edge of the blade is engaged with a surface of a photoreceptor, and the soft elastic members may be separated from the ends of the blade when the pointed edge of the blade is positioned away from the surface of the photoreceptor. The elastic members do not interfere with the rotation of the blade when the pointed edge of the blade is positioned adjacent the surface of the photoreceptor. And, since the elastic members are engaged with the ends of the blade while the pointed edge of the blade is engaged with the surface of the photoreceptor, the scattering of the toner from the ends of the blade can be prevented.

11 Claims, 5 Drawing Sheets

CLEANING DEVICE OF IMAGE-FORMING APPARATUS

BACKGROUND OF THE INVENTION

1. Field of the Invention

The present invention relates to a cleaning device mounted in an image-forming apparatus such as an electrostatic photographic copying machine or a facsimile machine.

2. Description of the Prior Art

A known cleaning device in an image-forming apparatus includes an elastic blade for engaging a surface of a photoreceptor at a pointed edge thereof to separate residual toner from said surface of the photoreceptor, said blade being rotatably mounted to a housing so as to be separable from said surface of the photoreceptor during a non-cleaning state. And, a soft elastic member occupying a gap between an end of said elastic blade and a side plate of the housing is mounted to said side plate of the housing so as to prevent the toner from scattering from both ends of the elastic blade.

Although the soft elastic member has been formed of materials having various kinds of properties, such as remarkably soft materials or slightly hard materials, in the case where the remarkably soft materials are used, the prevention of the toner from scattering is apt to be reduced, while in the case where the slightly hard materials are used, the prevention of the toner from scattering is superior but the slightly hard elastic member interferes with both ends of the blade to a great extent when said elastic blade is rotated. Thus, both ends of said elastic blade are apt to be deformed by the slightly hard elastic members during the rotation of said elastic blade, whereby the toner may scatter through the deformed portion.

SUMMARY OF THE INVENTION

The present invention has been achieved in view of the above-described circumstances and it is an object of the present invention to prevent an elastic member from interfering with an elastic blade to a great extent with remarkably simple structure even though said soft elastic member is formed of materials which are hard to some extent.

In order to achieve the above-described object, a cleaning device of an image-forming apparatus according to the present invention comprises an elastic blade for engaging a surface of a photoreceptor at a pointed edge thereof to separate residual toner from said surface of the photoreceptor, the blade being rotatably mounted to a housing so as to be separable from said surface of the photoreceptor, elastic members respectively disposed between side plates of the housing and ends of said elastic blade, said soft elastic members being movable in the direction of the rotational axis of the elastic blade, and an interlocking mechanism for moving and separating said soft elastic members toward and away from each other during the rotation of said elastic blade. The interlocking mechanism causes said soft elastic members to engage the ends of the blade when said pointed edge of the blade is engaged with said surface of the photoreceptor, and causes said soft elastic members to be separated from the ends of the blade when said pointed edge of the blade is positioned away from the surface of the photoreceptor.

With the above-described structure, said soft elastic members are separated from the ends of the blade when said pointed edge of the blade is positioned away from the surface of the photoreceptor so that said soft elastic members do not interfere with the rotation of the elastic blade from this position. Accordingly, the deformation of the ends of the blade during the rotation of said elastic blade can be effectively prevented.

And, since said soft elastic members are engaged with the ends of the blade when said pointed edge of the blade is engaged with the surface of the photoreceptor, the toner can be prevented from being scattered from the ends of said blade.

It has been known that if said elastic blade is reciprocally moved in the direction of the axis of the shaft thereof while said pointed edge thereof is engaged with the surface of the receptor in an intimate manner, the cleaning effect is enhanced.

There arises, however, the possibility that if said elastic blade is simply reciprocally moved in the direction of the axis of the shaft thereof, the soft elastic member on the downstream side in the moving direction of said elastic blade is repeatedly pressed at every reciprocal movement of the elastic blade so as to be deformed while a gap is formed between the soft elastic member on the upstream side in the moving direction of said elastic blade and the respective end face of the blade which allows the toner to scatter from the gap.

However, in the present invention, the interlocking mechanism comprises a separating and energizing member for supporting said soft elastic members and urging said soft elastic members in the direction in which the soft elastic members separate from the end faces of the blade, and an engaging and operating member for moving said soft elastic member into engagement with the ends of the blade against the urging force of said separating and energizing member when said pointed edge of the blade is engaged with the surface of the photoreceptor. Alternatively, the interlocking mechanism comprises an engaging and energizing member for supporting said soft elastic members and urging said soft elastic members into engagement with the ends of the blade, and a separating and operating member for separating said soft elastic members from the ends of the blade against the urging force of said engaging and energizing member when said pointed edge of the blade is positioned adjacent the surface of the photoreceptor and said elastic blade is moved in the direction of the axis of the shaft thereof. Also, said soft elastic members are moved in the same direction as and in conjunction with the movement of said elastic blade, whereby the tendencies of the soft elastic member on the downstream side in the moving direction of the elastic blade to be deformed and of the formation of a gap between the soft elastic member on the upstream side in the moving direction of the elastic blade and the respective end face of the blade are prevented.

DETAILED DESCRIPTION OF THE PREFERRED EMBODIMENTS

Figure 1:
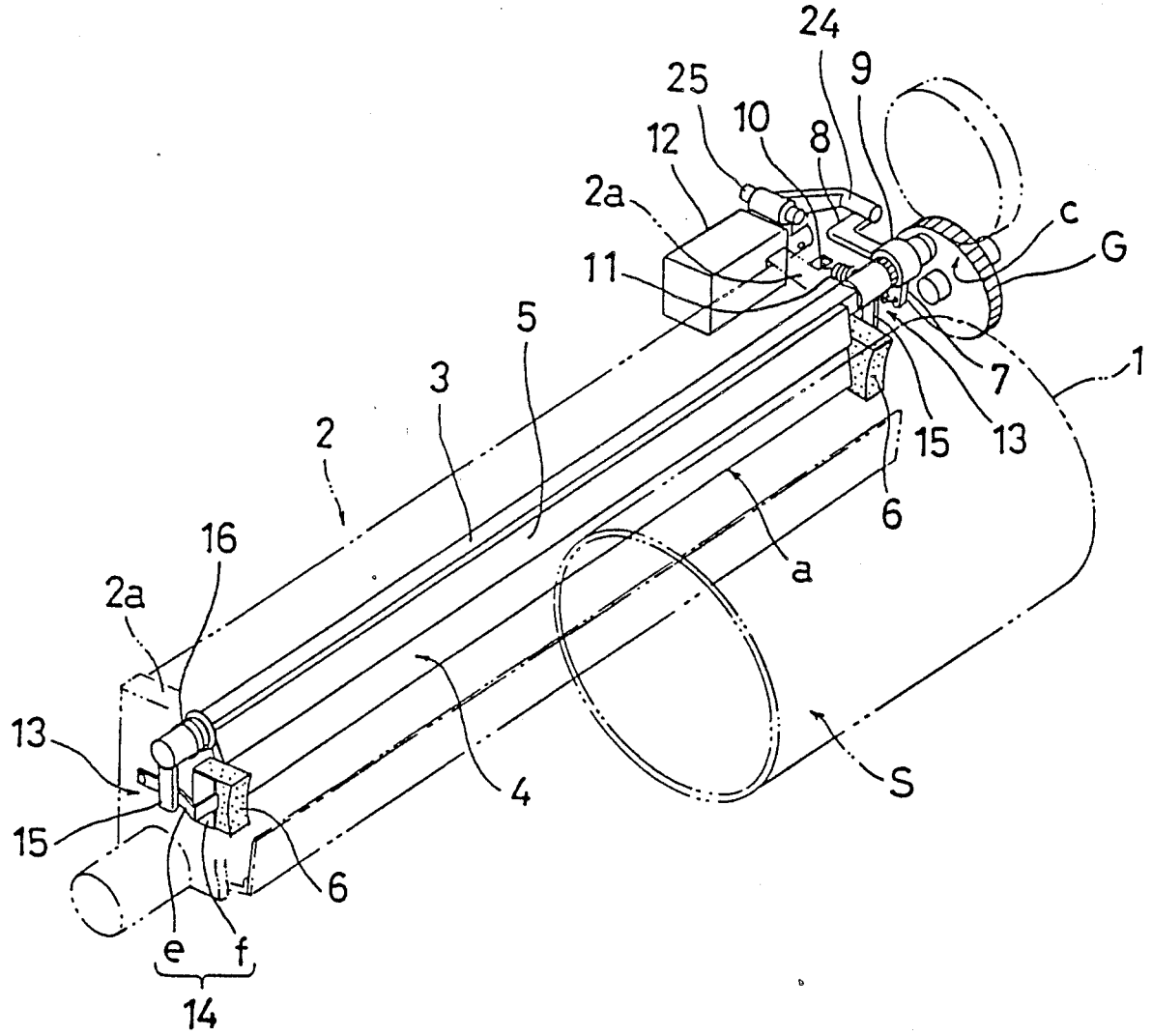
FIG. 1 is a perspective view of a cleaning device according to the present invention.

The preferred embodiments of the present invention will be described below with reference to the drawings. Referring now to FIG. 1 showing a cleaning device mounted on an electrostatic photographic copying machine as one example of an image-forming apparatus, a housing 2 open to a photoreceptor 1 is provided with a blade shaft 3 mounted on right and left side plates 2a, 2a thereof so as to be reciprocally movable in the direction of the axis of the shaft and rotatable about the axis of the shaft, said axis being parallel to a rotation axis of said photoreceptor 1. An elastic blade 4, which is formed of urethane rubber for example, and which is slightly longer than a largest latent image zone of said photoreceptor 1, is mounted on said blade shaft 3 through a holder 5. Soft elastic members 6, 6 (for example sponge) occupy gaps between both end faces of said elastic blade 4 and said side plates 2a, 2a of the housing 2, as shown in FIG. 2, to prevent toner from being scattered from both end portions of said elastic blade 4.

And, a boss 9 provided with a linear arm 7 and an L-shaped arm 8 is disposed on one end of said blade shaft 3. Energizing means 11 (a coil spring is illustrated) for urgingly separating a pointed edge a of said elastic blade 4 from a surface S of said photoreceptor 1 extends from said linear arm 7 of said boss 9 to a hook 10 of said side plate 2a of the housing 2. A bell crank 24, which is engaged with an end portion of said arm 8 at one end thereof, is rotatable about an axis 25 extending at a right angle to said blade shaft 3. The bell crank 24 is provided with a solenoid 12 for moving said pointed edge a of the blade 4 into engagement with said surface S of the photoreceptor 1 against the urging force of the energizing means 11. Thus, the pointed edge a of said elastic blade 4 is movable between a position at which edge a is engaged with the surface S of the photoreceptor 1 and a position at which the pointed edge a of said elastic blade 4 is separated from the surface S of the photoreceptor 1.

Figure 2:
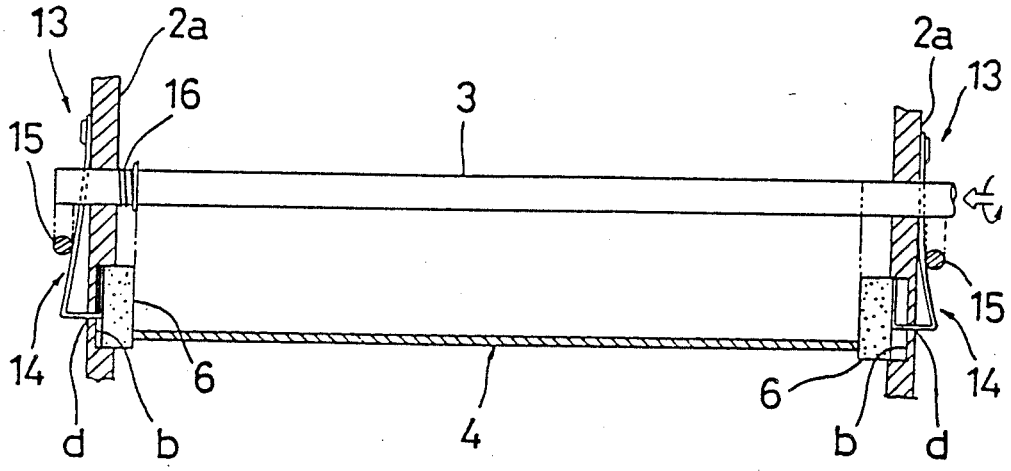
FIGS. 2, 3 are partial sectional views illustrating the actuation of an elastic member by an interlocking mechanism in the cleaning device of FIG. 1.
Figure 3:
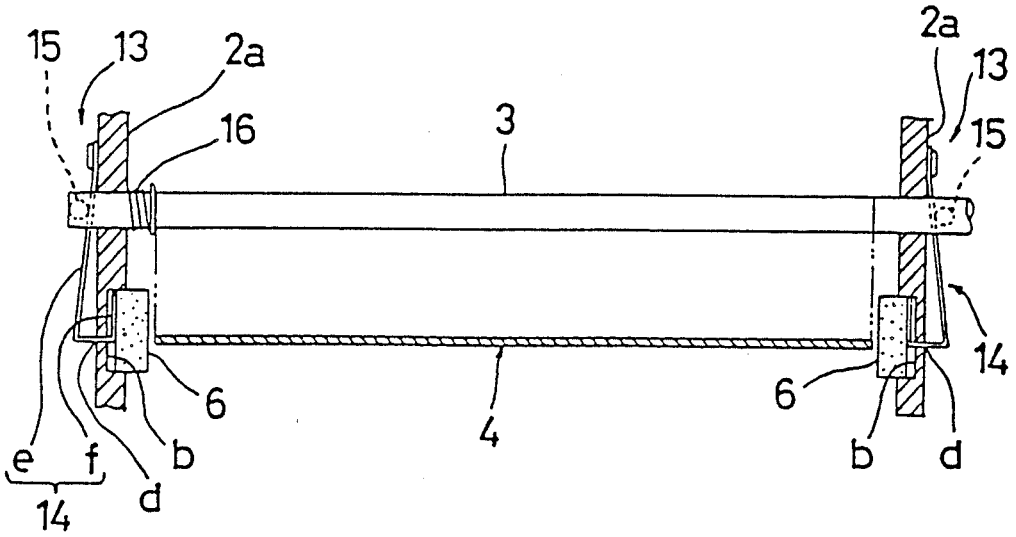

As also shown in FIGS. 2, 3, an interlocking mechanism 13 for moving and separating said soft elastic members 6, 6 toward and away from each other in conjunction with the rotation of said elastic blade 4 causes said soft elastic members 6, 6 to engage the ends of the blade when said pointed edge a of the blade 4 is engaged with said surface S of the photoreceptor 1, and causes said soft elastic members 6, 6 to move from the ends of the blade when said pointed edge a separates from the surface S of the photoreceptor 1. Thus, the soft elastic members 6, 6 do not interfere with the ends of said elastic blade 4 during the rotation of said elastic blade 4 as said pointed edge a of the blade 4 is separated from the surface S of the photoreceptor whereby the ends of the blade can be prevented from being deformed.

Recesses b, b for accommodating said soft elastic members 6, 6 therein are formed on inner surfaces of said interlocking mechanism 13, and in particular, in said side plates 2a, 2a of the housing 2. Rectangular holes d, d face said recesses b, b. Said soft elastic members 6, 6 adhere to a holding plate portion f of a separating and energizing member 14. Said holding plate portion f is disposed on one end of an L-shaped portion e, said L-shaped portion e being inserted through said rectangular hole d from the inner surface of the side plate of the housing. The other end of said L-shaped plate portion e is clamped to an outer side of said side plate 2a of the housing with said L-shaped plate portion e being bent so that each said soft elastic member 6 is normally separated from a respective end of the blade.

Engaging and operating members 15, disposed at respective ends of shaft 3, position said soft elastic members 6, 6 away from the ends of the blade against the separating and energizing force of said separating and energizing members 14 when said pointed edge a of the blade is positioned away from the surface S of the photoreceptor. Said soft elastic members 6, 6 are separated from the ends of the blade until said pointed edge a of the blade is engaged with the surface S of the photoreceptor (first position of the blade shown in FIG. 3) and said soft elastic members 6, 6 are engaged with the ends of the blade when said pointed edge a of the blade is engaged with the surface S of the photoreceptor (second position of the blade shown in FIG. 2).

In addition, said soft elastic members 6, 6 may be adapted to be engaged with the ends of the blade after said pointed edge a of the blade is engaged with the surface S of the photoreceptor but before said pointed end a of the blade arrives at the appointed cleaning position.

Referring to FIG. 1 again, a rotary gear G with one side thereof defining a cam surface c having a gentle slope is engaged with one end of said blade shaft 3. And, returning means (a coil spring is illustrated) 16 for urging said one end of the blade shaft 3 into engagement with said cam surface c is provided between the other end of said blade shaft 3 and the side plate 2a of the housing so that said blade shaft 3, and thus the elastic blade 4, may be moved slightly in the direction of the axis of the shaft during the rotation of said gear G. In this way, the pointed edge a of the blade can be engaged with said surface S of the photoreceptor in an intimate manner and the elastic blade 4 can be reciprocated with said pointed edge a of the blade engaged with the surface S of the photoreceptor so that the cleaning effect can be enhanced.

Here, the engaging and operating members 15, 15 connected with said blade shaft 3 are moved integrally with the blade shaft 3 during the movement of the blade shaft 3 in the direction of the axis of the shaft. Also, said soft elastic members 6, 6 are moved in conjunction with the movement of said engaging and operating members 15, 15, so that the positional relationship between said soft elastic members 6, 6 and said elastic blade 4 is maintained so that the soft elastic member 6 on the downstream side in the moving direction can be prevented from being pressed by the movement of said elastic blade 4 in the direction of the axis of the shaft and so that no gap is formed between the soft elastic member 6 on the upstream side in the moving direction and the end of the blade.

Figure 4:
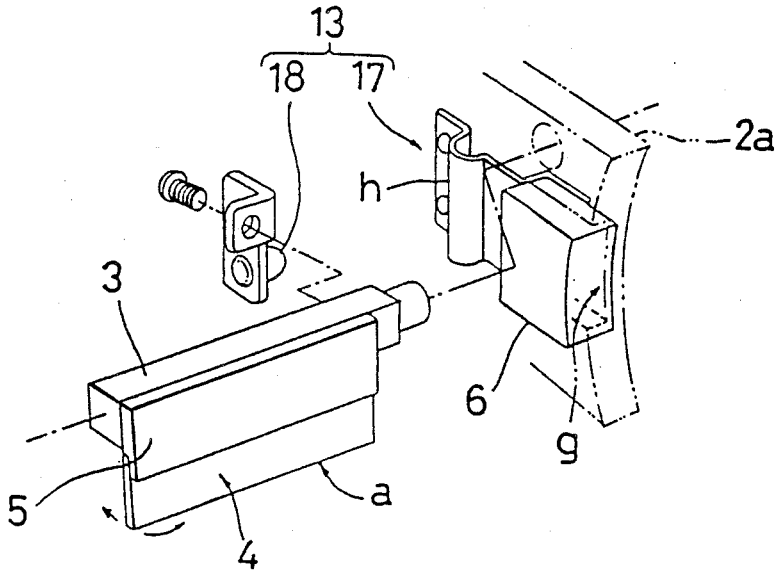
FIG. 4 is an exploded perspective view of principal parts of an interlocking mechanism according to another preferred embodiment of a cleaning device according to the present invention.

FIG. 4 shows another preferred embodiment of the interlocking mechanism 13. This interlocking mechanism 13 is provided with a recess g for accommodating the soft elastic member 6 therein, the recess g being formed on an inner surface of the side plate 2*a* of the housing. The soft elastic member 6 adheres to one end of an engaging and energizing member 17 provided with a bent big portion h in a middle portion thereof. The other end of said engaging and energizing member 17 is clamped to the side of said side plate 2*a* of the housing. Said engaging and energizing member 17 is bent so that said soft elastic member 6 may be urged into engagement with the end of the blade.

A separating and operating member 18 presses said big portion h against the urging force of said engaging and energizing member 17 so that when the pointed edge a of the elastic blade 4 is positioned away from the surface of the photoreceptor, said soft elastic member 6 is separated from the end of the blade. A respective said separating and operating member 18 is provided at each end of the blade shaft 3.

Figure 5:
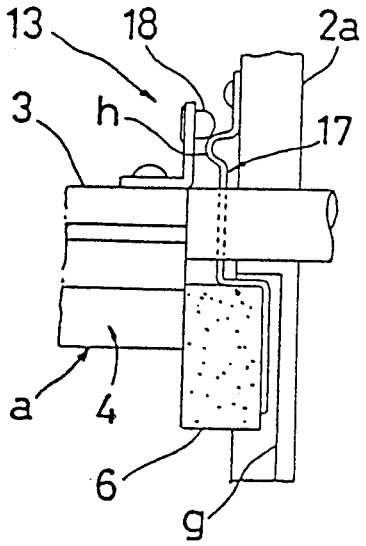
FIGS. 5 to 7 are partial sectional views illustrating the actuation of an elastic member by an interlocking mechanism according to the preferred embodiment of FIG. 4.
Figure 6:
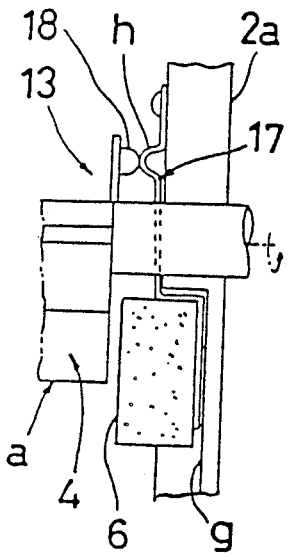

More specifically, said soft elastic member 6 is urged into engagement with an end of the elastic blade 4 under the non-cleaning state in which said pointed edge a of the blade is separated from the surface of the photoreceptor (second position shown in FIG. 5). But, as said elastic blade 4 is rotated to place the pointed edge a thereof into engagement with said surface of the photoreceptor, when the pointed edge a of the blade is positioned adjacent the photoreceptor midway of the rotation thereof, said big portion h is pressed by the separating and operating member 18 whereby said soft elastic member 6 is separated from the end of the blade (first position shown in FIG. 6).

Figure 7:
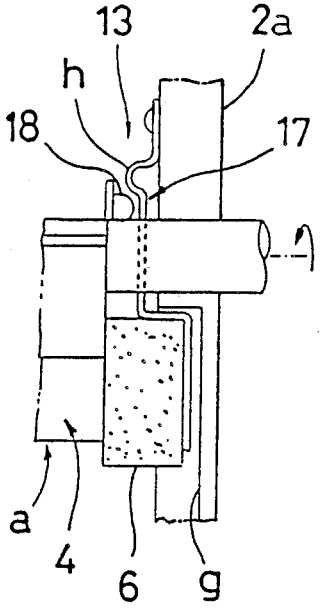

And, when said separating and operating member 18 has moved over the big portion h upon further rotation of said elastic blade 4 when said pointed edge a of the blade is engaged with the surface of the photoreceptor, said soft elastic member 6 is again urged into engagement with the end of the blade under the urging force of the engaging and energizing member 17 (refer to FIG. 7).

That is to say, the soft elastic member 6, which has been urged into engagement with the end of the blade, is once separated from the end of the blade immediately before said pointed edge a of the blade is engaged with the surface of the photoreceptor, and said soft elastic member 6 is urged into engagement with the end of the blade when said pointed edge a of the blade is engaged with the surface of the photoreceptor. Thus, the soft elastic members 6, 6 do not interfere with the ends of said elastic blade 4 and said ends of the blade can be prevented from being deformed by separating said soft elastic members 6, 6 from the end of the blade during the rotation thereof.

It goes without saying that said separating and operating member 18 is also moved integrally with said elastic blade 4 during the movement of the elastic blade 4 in the direction of the axis of the shaft. And, said soft elastic member 6 is moved in conjunction with the movement of said separating and operating member 18 so that the positional relationship between said soft elastic member 6 and said elastic blade 4 is maintained. Thus, the soft elastic member 6 on the downstream side in the moving direction is not pressed against one end of the blade nor is a gap formed between the soft elastic member 6 on the upstream side in the moving direction and the other end of the blade during the movement of said elastic blade 4 in the direction of the axis of the shaft.

Figure 8:
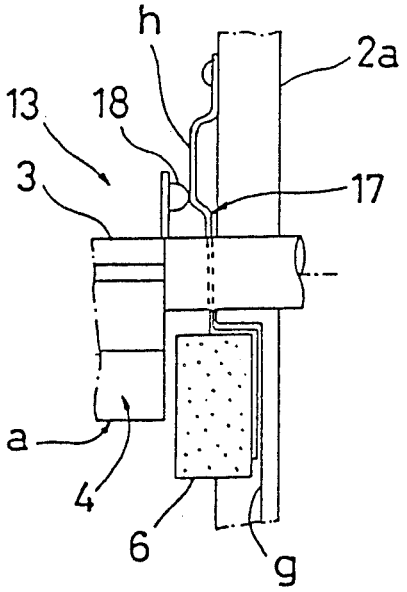
FIG. 8 is a sectional view of a modification, according to the present invention, of the preferred embodiment of FIG. 4.

A modification of the interlocking mechanism 13 of the above-described another preferred embodiment is shown in FIG. 8. In this case, said soft elastic member 6 is always separated from the end of the blade when said pointed edge a of the blade is separated from the surface of the photoreceptor due to a comparatively longer big portion h which is pressed during the rotation of said elastic blade 4.

Figure 9:
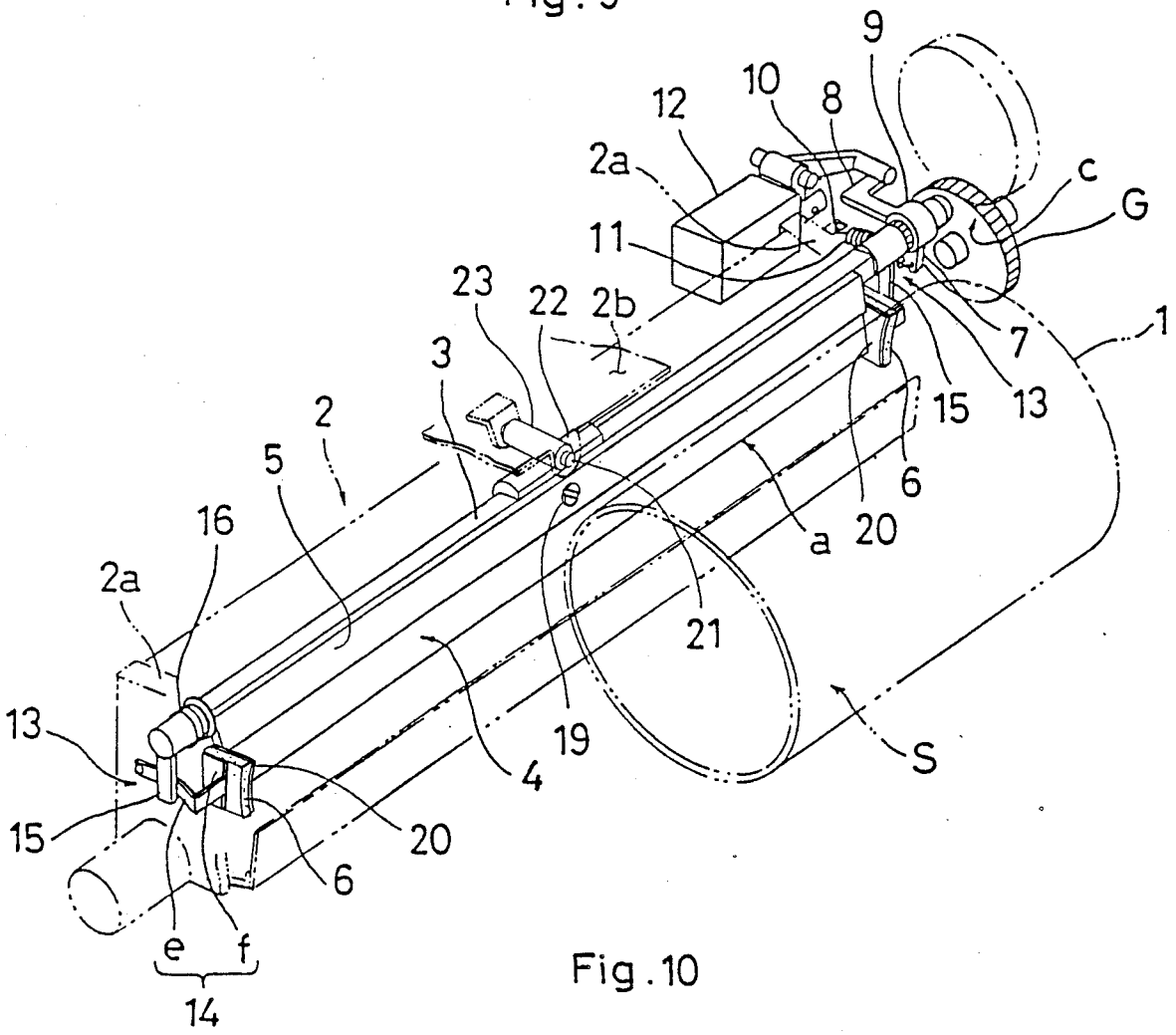
FIG. 9 is a perspective view of a cleaning device according to yet another preferred embodiment of the present invention.

FIG. 9 shows another preferred embodiment of a cleaning device according to the present invention.

This cleaning device was realized by adding the following improvements to the structure of the preferred embodiment described with reference to FIGS. 1 to 3. The same constituent parts as in the above-described preferred embodiment are labelled with the same reference numerals and characters as in the above-described preferred embodiment, and only parts different in structure and operation and yielding different effects are described.

In such a cleaning device according to the present invention, a blade holder 5 is pivotally mounted midway, in the longitudinal direction thereof, of a blade shaft 3 via a shaft 19. Shaft 19 has a pivot axis extending at a right angle with the rotary axis of the photoreceptor. An elastic blade 4 is mounted on said blade holder 5, and a sheet-like low-friction member 20, such as NITOFLON TAPE (trade name of Nitto Electric Industries, Inc.), adheres to a surface portion where of the elastic members 6, 6 at which both ends of said elastic blade 4 confront the soft elastic members 6, 6, respectively.

A nearly semicircular member 22 is mounted on said blade shaft 3 adjacent said holder-pivoting shaft 19. And, a roller type load-supporting means 23 disposed on said semicurcular member 22 is mounted on a top plate 2*b* of a housing so as to be rotatable around a shaft 21 extending parallel to said holder-pivoting shaft 19.

With the above-described structure, said elastic blade 4 is pivotable about the holder-pivoting shaft 19, so that upon the rotation of said elastic blade when a pointed edge of said blade 4 is brought into intimate contact with a surface S of the photoreceptor, said pointed edge a of the blade can be engaged with the surface S of the photoreceptor under an almost equal pressure.

And, upon the engaging of the elastic blade 4 with said surface S of the photoreceptor, a load, which acts upon said elastic blade 4 due to the rotation of said photoreceptor 1, is concentrically applied to said blade shaft 3 through said holder-pivoting shaft 19 and would tend to bend said blade shaft 3 to the extent of which, for example, the movement in the direction of the axis of the shaft and the rotation of the blade shaft 3 would become impossible according to such circumstances. However, said blade shaft 3 can be effectively prevented from being bent by means of the load-supporting means 23 because said load-supporting means 23 is rotatable so that said movement in the direction of the axis of the shaft line and the rotation of the blade shaft 3 can occur.

In addition, since the low-friction member 20 is mounted on said soft elastic member 6, the functional resistance on both ends of the blade when in contact with said soft elastic members 6, 6 can be reduced.

Figure 10:
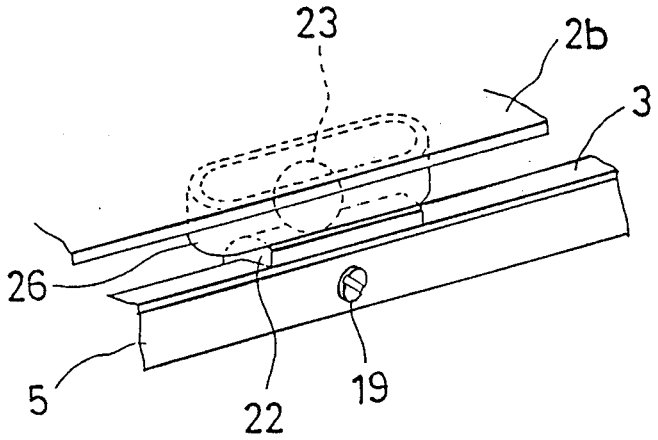
FIG. 10 is a perspective view of a modification of load-supporting means of the cleaning device in the preferred embodiment of FIG. 9.

Another preferred embodiment of the load-supporting means is shown in FIG. 10. In this case, the load-supporting means comprises a ball, and a ball-holding means 26 for holding said load-supporting ball 23 mounted on a top plate 2*b* of a housing. Said ball-holding means 26 is provided with a space so as to be capable of rolling over said load-supporting ball 23 in the direction of the axis of the blade shaft 3. Accordingly, this embodiment is characterized by said blade shaft 3 being able to be smoothly rotated.

In addition, although said elastic blade 4 is adapted to be movable in the direction of the rotational axis thereof to allow a pointed edge a of the blade to be moved into engagement with a surface S of a photoreceptor in the intimate manner described above with respect to preferred embodiments, this is not essential in the present invention.

As described above, according to the present invention, said soft elastic member is adapted to be separated from the end of the blade when the pointed edge of the blade is positioned away from the surface of the photoreceptor so that said soft elastic member does not interfere with the rotation of the elastic blade from such a position. Thus, the deformation of the ends of the blade during the rotation of said elastic blade can be effectively prevented even though said soft elastic member is formed of materials which are hard to some extent.

And, said soft elastic member is engaged with the end of the blade when said pointed edge of the blade is engaged with the surface of the photoreceptor, so that the scattering of the toner from said ends of the blade can be ensuredly prevented.

Besides, even in the cleaning mode, in which said elastic blade is reciprocally moved in the direction of the axis of the shaft while said pointed edge of the blade is intimately engaged with said surface of the photoreceptor, one soft elastic member is not pressed against said elastic blade nor is a gap formed between the other soft elastic member and the respective end of the blade due to the movement of said soft elastic members in conjunction with the movement of said elastic blade. Thus, all of the conventional disadvantages can be eliminated by simple structure according to the present invention.

I claim:

1. A cleaning device for use in an image-forming apparatus, said cleaning device comprising:

a housing including spaced-apart side plates;

an elastic blade disposed between said side plates of said housing and rotatably mounted to said housing about a rotation axis of the blade, said elastic blade being rotatable relative to said housing about said axis between first and second positions of the blade, said elastic blade having opposite ends respectively located adjacent the side plates of said housing, and said elastic blade defining a pointed free edge thereof extending between said opposite ends and spaced from said rotation axis;

a respective elastic member disposed between each of said side plates and the end of said elastic blade adjacent thereto; and an interlocking mechanism supporting each of the elastic members between a respective one of said side plates and the end of said elastic blade adjacent thereto, said interlocking mechanism moving said elastic members toward and away from each other into and out of engagement with the ends of said elastic blade as said elastic blade is rotated between said positions thereof.

2. A cleaning device as claimed in claim 1, wherein said interlocking mechanism comprises a separating and energizing member supporting each of the elastic members between a respective one of said side plates and the end of the elastic blade adjacent thereto while exerting an urging force that urges each of the elastic members away from and out of engagement with the respective end of said blade adjacent thereto, and an engaging and operating member connected to said blade so as to move in conjunction therewith, said engaging and operating member operatively engageable with each of the elastic members for moving the elastic members into engagement with the ends of said elastic blade, respectively, against the urging force exerted by said separating and energizing member as said blade is rotated from said first position to said second position thereof.

3. A cleaning device as claimed in claim 2, wherein said elastic blade is mounted to said side plates so as to also be axially movable along the rotation axis thereof when at said second position.

4. A cleaning device as claimed in claim 1, wherein said interlocking mechanism comprises a separating and energizing member supporting each of the elastic members between a respective one of said side plates and the end of the elastic blade adjacent thereto while exerting an urging force that urges each of the elastic members toward and into engagement with the respective end of said blade adjacent thereto, and an engaging and operating member connected to said blade so as to move in conjunction therewith, said engaging and operating member operatively engageable with each of the elastic members for moving the elastic members out of engagement with the ends of said elastic blade, respectively, against the urging force exerted by said separating and energizing member as said blade is rotated from said second position to said first position thereof.

5. A cleaning device as claimed in claim 4, wherein said elastic blade is mounted to said side plates so as to also be axially movable along the rotation axis thereof when at said second position.

6. In an image-forming apparatus having a photoreceptor on which an image is formed with toner, a cleaning device for cleaning the photoreceptor of residual toner, said device comprising:

a housing mounted in the apparatus adjacent the photoreceptor and including spaced-apart side plates;

an elastic blade disposed between said side plates of said housing and rotatably mounted to said housing about a pivot axis of the blade, said elastic blade having opposite ends respectively located adjacent the side plates of said housing, said elastic blade defining a pointed free edge thereof extending between said opposite ends and spaced from said rotation axis, and said elastic blade being rotatable about said rotation axis between a first position at which said free edge of the blade is located away from the outer surface of the photoreceptor and a second position at which the free edge of the blade contacts the outer surface of the photoreceptor;

a respective elastic member disposed between each of said side plates and the end of said elastic blade adjacent thereto; and an interlocking mechanism supporting each of the elastic members between a respective one of said side plates and the end of said elastic blade adjacent thereto, said interlocking mechanism moving said elastic members toward and away from each other into and out of engagement with the ends of said elastic blade as said elastic blade is rotated between said positions thereof.

7. The cleaning device in the image-forming apparatus as claimed in claim 6, wherein said interlocking mechanism comprises a separating and energizing member supporting each of the elastic members between a respective one of said side plates and the end of the elastic blade adjacent thereto while exerting an urging force that urges each of the elastic members away from and out of engagement with the respective end of said blade adjacent thereto, and an engaging and operating member connected to said blade so as to move in conjunction therewith, said engaging and operating member operatively engageable with each of the elastic members for moving the elastic members into engagement with the ends of said elastic blade, respectively, against the urging force exerted by said separating and energizing member as said blade is rotated from said first position to said second position thereof.

8. The cleaning device in the image-forming apparatus as claimed in claim 7, wherein said elastic blade is mounted to said side plates so as to also be axially movable along the rotation axis thereof when at said second position, and further comprising axial drive means operatively connected to said elastic blade for moving said elastic blade axially along the rotation axis thereof.

9. The cleaning device in the image-forming apparatus as claimed in claim 6, wherein said interlocking mechanism comprises a separating and energizing member supporting each of the elastic members between a respective one of said side plates and the end of the elastic blade adjacent thereto while exerting an urging force that urges each of the elastic members toward and into engagement with the respective end of said blade adjacent thereto, and an engaging and operating member connected to said blade so as to move in conjunction therewith, said engaging and operating member operatively engageable with each of the elastic members for moving the elastic members out of engagement with the ends of said elastic blade, respectively, against the urging force exerted by said separating and energizing member as said blade is rotated from said second position to said first position thereof.

10. The cleaning device in the image-forming apparatus as claimed in claim 9, wherein said elastic blade is mounted to said side plates so as to also be axially movable along the rotation axis thereof when at said second position, and further comprising axial drive means operatively connected to said elastic blade for moving said elastic blade axially along the rotation axis thereof.

11. The cleaning device in the image-forming apparatus as claimed in claim 6, and further comprising drive means mounted in the apparatus and operatively connected to said elastic blade for rotating said blade between said positions thereof.

* * * * *